US010124473B2

(12) United States Patent
Wang

(10) Patent No.: US 10,124,473 B2
(45) Date of Patent: Nov. 13, 2018

(54) SCREWDRIVER BIT ASSEMBLY WITH A MAGNETIC STRUCTURE

(71) Applicant: Tzu-Chien Wang, Tainan (TW)

(72) Inventor: Tzu-Chien Wang, Tainan (TW)

(73) Assignee: Chia-Feng Chang, Taipei (TW)

( * ) Notice: Subject to any disclaimer, the term of this patent is extended or adjusted under 35 U.S.C. 154(b) by 334 days.

(21) Appl. No.: 15/130,715

(22) Filed: Apr. 15, 2016

(65) Prior Publication Data

US 2017/0297183 A1 Oct. 19, 2017

(51) Int. Cl.
*B25B 23/12* (2006.01)
*B25B 15/00* (2006.01)

(52) U.S. Cl.
CPC ..... *B25B 23/12* (2013.01); *B25B 15/001* (2013.01)

(58) Field of Classification Search
None
See application file for complete search history.

(56) References Cited

U.S. PATENT DOCUMENTS

2009/0139378 A1* 6/2009 Chiang ..... B25B 23/0035 81/438
2015/0336246 A1* 11/2015 Peters ..... B23B 31/107 81/439
2016/0016298 A1* 1/2016 Zhang ..... B25B 23/0035 81/451

* cited by examiner

*Primary Examiner* — Joseph J Hail
*Assistant Examiner* — Brian D Keller

(57) ABSTRACT

A screwdriver bit assembly includes a magnetic ring mounted in a front end of a sleeve hole of a sleeve. A retaining ring is made of a material more rigid than the sleeve, is mounted in the sleeve hole, and is located behind the magnetic ring. A screwdriver bit includes an insertion end, an extending section behind the insertion end, a flange section behind the extending section, and a clamping section behind the flange section. The front end of the screwdriver bit extends through the sleeve hole of the sleeve, the retaining ring, and the magnetic ring. The insertion end extends beyond the sleeve and is located in front of a front end face of the sleeve. The flange section abuts the retaining ring. The clamping section is held by a holding device mounted on the sleeve, providing a holding force towards a longitudinal axis of the sleeve hole.

3 Claims, 8 Drawing Sheets

A - A

SCREWDRIVER BIT ASSEMBLY WITH A MAGNETIC STRUCTURE

BACKGROUND OF THE INVENTION

The present invention relates to a screwdriver bit assembly with a magnetic structure and, more particularly, to a screwdriver bit assembly with a magnetic structure for reliably attracting a screw for the purposes of increasing operational stability.

A conventional screwdriver bit generally includes a shank having a front end with an insertion end in the form of a Phillips head tip, a cabinet tip, or a polygonal tip. The insertion end of the screwdriver bit can be coupled with a correspondingly shaped groove in an end of a screw, and the screwdriver bit can be rotated to tighten or loosen the screw. To permit easy operation, the insertion end of the screwdriver bit is provided with magnetism for attracting the screw. However, the attracting force provided by the screwdriver bit is weak, such that the screw is apt to fall off when the screwdriver bit wobbles.

In an approach to solve the above disadvantage, a sleeve is mounted on the front end of the screwdriver bit. The sleeve includes a hole through which the screwdriver bit extends. A magnetic member is mounted to a front end of the sleeve. The sleeve is generally made of a plastic material having low magnetic conductivity to avoid larger magnetism on the outer periphery of the sleeve. After the sleeve is mounted on the front end of the screwdriver bit, the magnetic member on the front end of the sleeve can absorb a screw to provide convenient operation.

FIG. 8 shows a structure disclosed by Taiwan Invention Patent No. I254660. The structure a plastic sleeve 1', a magnetic member 2', and a screwdriver bit 3'. The sleeve 1' includes a central hole 11' having a reduced coupling section 12' at a rear end thereof. The magnetic member 2' is mounted to the front end of the sleeve 1' and includes a through-hole 21' having a diameter smaller than a diameter of the central hole 11'. The screwdriver bit 3' extends through the central hole 11' and the through-hole 21'. The screwdriver bit 3' includes a reduced portion 31' engaged in the reduced coupling section 12' to restrain movement of the sleeve 1', preventing the sleeve 1' from disengaging from the screwdriver bit 3'.

In use, the magnetic member 2' attracts the screw 4' to provide secure engagement between the front end of the screwdriver bit 3' and the screw 4'. However, the sleeve 1' engages with the reduced portion 31' of the screwdriver bit 3' merely by the reduced coupling section 12', providing insufficient engagement stability. In a case that the screwdriver bit 3' is driven by a high-speed electric tool to threadedly fix the screw 4' into a workpiece 5', no stopping mechanism is provided between the sleeve 1' and the screwdriver bit 3', such that the screwdriver bit 3' and the screw 4' could move further forward into the workpiece 5' due to inadvertent operation or vibrations. The screwdriver bit 3' could move forward relative to the sleeve 1' (see the arrow in FIG. 8), such that the screw 4' cannot be reliably attracted by the magnetic member 2' on the sleeve 1' and such that the workpiece 5' could be damaged.

BRIEF SUMMARY OF THE INVENTION

An objective of the present invention is to provide a screwdriver bit assembly with a magnetic structure for reliably attracting a screw for the purposes of increasing operational stability.

A screwdriver bit assembly according to the present invention includes a sleeve having a front end face, a rear end face, and an outer peripheral face between the front end face and the rear end face. The sleeve further includes a sleeve hole extending from the front end face through the rear end face. A magnetic ring is mounted in a front end of the sleeve hole of the sleeve. The magnetic ring includes a through-hole in a central portion thereof. A retaining ring is made of a material more rigid than the sleeve, is mounted in the sleeve hole, and is located behind the magnetic ring. The retaining ring includes a through-hole in a central portion thereof. A holding device is mounted on the sleeve, providing a holding force towards a longitudinal axis of the sleeve hole. A screwdriver bit has a rigidity larger than the sleeve. The screwdriver bit includes an insertion end on a front end thereof, a coupling end on a rear end thereof, and an extending section behind the insertion end. The coupling end is adapted to couple with an external tool. The screwdriver bit further includes a flange section located behind the extending section and having a diameter larger than a diameter of the extending section. The screwdriver bit further includes a clamping section behind the flange section. The front end of the screwdriver bit extends through the sleeve hole of the sleeve, the through-hole of the retaining ring, and the through-hole of the magnetic ring. The insertion end extends beyond the sleeve and is located in front of the front end face of the sleeve. The flange section has a front side abutting the retaining ring. The clamping section is held by the holding device.

The sleeve hole of the sleeve can include an inner flange section extending from an inner periphery of the front end of the sleeve hole towards the longitudinal axis. The inner flange section defines a first hole section. The inner flange section has a first stop wall and a second stop wall respectively located on front and rear sides of the inner flange section. A second hole section is defined between the front stop wall and the front end face of the sleeve and has a diameter larger than a diameter of the first hole section. The magnetic ring is mounted in the second hole section. The sleeve hole can further include a third hole section located behind the second stop wall and having a diameter larger than the diameter of the first hole section. The retaining ring is mounted in the third hole section.

A front end of the magnetic ring can be flush with the front end face of the sleeve. A rear end of the magnetic ring can abut the first stop wall. The retaining ring can have an outer diameter substantially equal to the diameter of the third hole section and can abut the second stop wall.

The sleeve can be made of a material with low magnetic conductivity, such as aluminum or a rigid plastic.

The screwdriver bit can be made of metal, and the retaining ring can be made of low-carbon steel or high-carbon steel.

The sleeve can further include at least one through-hole extending radially from the outer peripheral face through an inner periphery of the sleeve hole. The at least one through-hole of the sleeve has a reduced section adjacent to the sleeve hole. The reduced section has a diameter smaller than a remaining portion of the at least one through-hole of the sleeve. The holding device includes at least one ball and a resilient ring. The at least one ball has a diameter smaller than the remaining portion of the at least one through-hole of the sleeve but larger than the diameter of the reduced section of the at least one through-hole. The at least ball is received in the at least one through-hole of the sleeve and is partially located in the sleeve hole of the sleeve. The resilient ring is mounted around the outer peripheral face of the sleeve. The resilient ring biases the at least one ball to press against the clamping section of the screwdriver bit.

In an example, the sleeve includes three through-holes annularly spaced from each other by 120°, and three balls are respectively received in the three through-holes.

The sleeve can further include an annular groove defined in the outer peripheral face. The three through-holes are defined in a bottom wall of the annular groove. The resilient ring is received in the annular groove.

When the insertion end of the screwdriver bit is inserted into the groove of the screw, the top end of the screw can be attracted by the magnetic ring, preventing the screw from falling off. When the screwdriver bit is rotated to tighten the screw to a workpiece or to detach the screw from the workpiece, the front end of the flange section abuts the retaining ring, avoiding the sleeve from moving rearwards relative to the screwdriver bit. Thus, reliable attraction between the magnetic ring and the screw is maintained to assure reliable and stable operation. Furthermore, since the magnetic ring abuts the flange section of the screwdriver bit, the screw and the screwdriver bit cannot move further into the workpiece when the front end face of the sleeve abuts against a surface of the workpiece, preventing damage to the workpiece. Since the retaining ring is made of a rigid material, wear is less likely to occur due to friction between the retaining ring and the flange section of the screwdriver bit, providing a longer service life. During rotation of the screwdriver bit, the clamping section of the screwdriver bit is securely held in a suitable clamped state by the balls, providing improved operational stability.

The present invention will become clearer in light of the following detailed description of illustrative embodiments of this invention described in connection with the drawings.

DETAILED DESCRIPTION OF THE INVENTION

Figure 1:
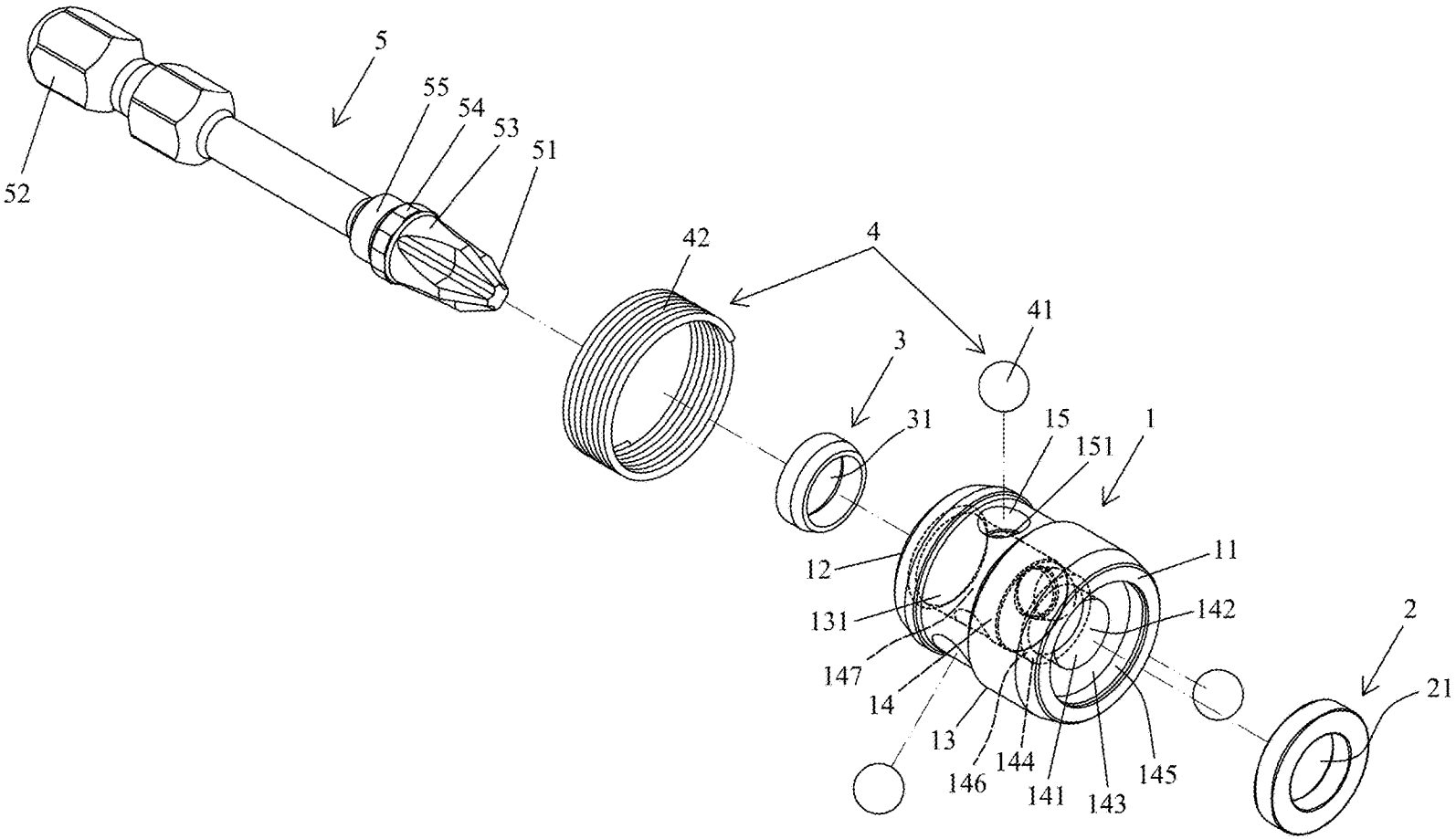
FIG. 1 is an exploded, perspective view of a screwdriver bit assembly according to the present invention.
Figure 2:
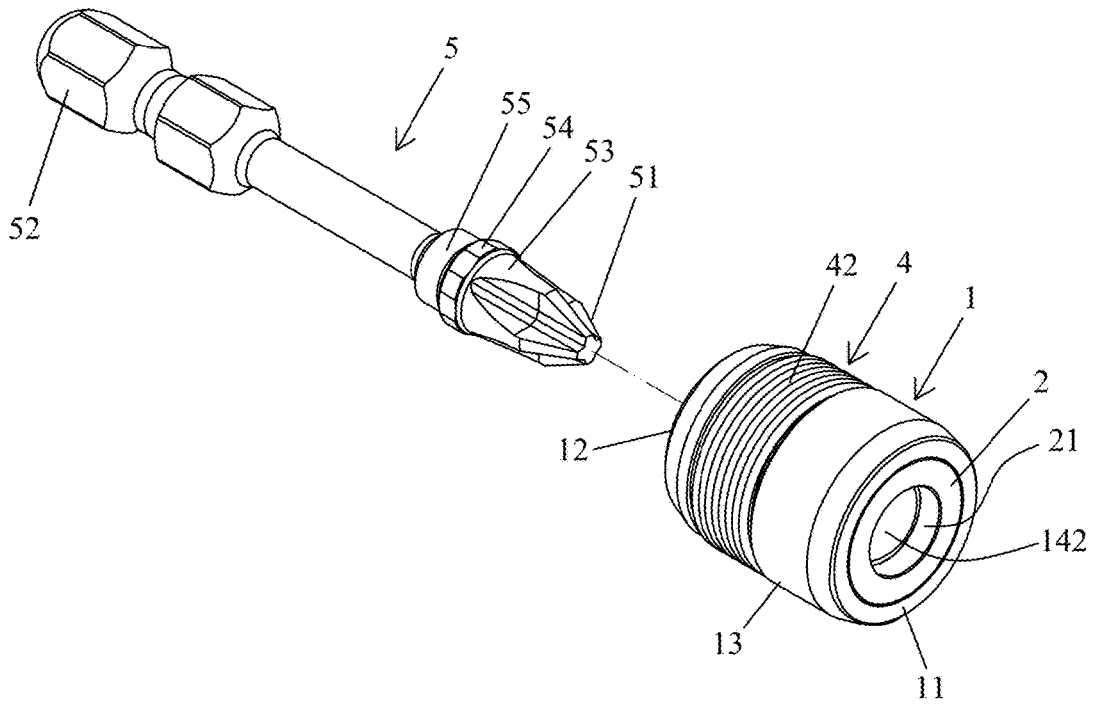
FIG. 2 is a partly exploded, perspective view of the screwdriver bit assembly of FIG. 1.
Figure 3:
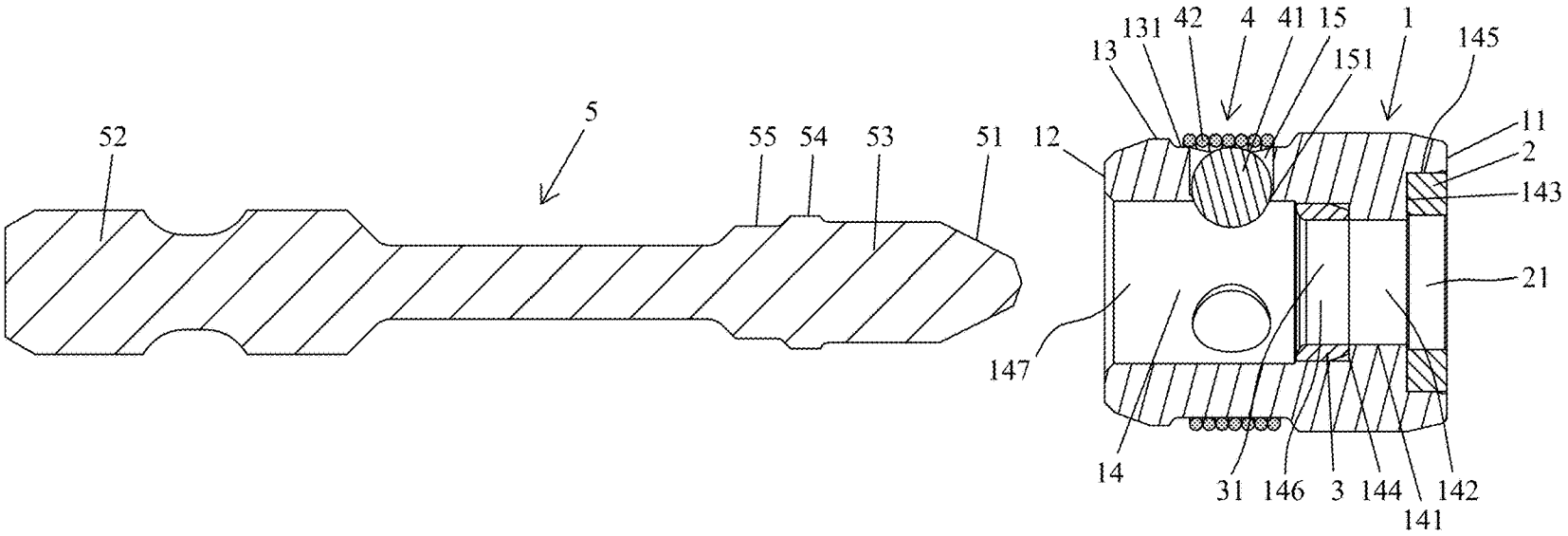
FIG. 3 is a cross sectional view of the screwdriver bit assembly to be assembled.

With reference to FIGS. 1-6, a screwdriver bit assembly includes a sleeve 1, a magnetic ring 2, a retaining ring 3, a holding device 4, and a screwdriver bit 5. The sleeve 1 is made of a material with low magnetic conductivity, such as aluminum or a rigid plastic. The sleeve 1 includes a front end face 11, a rear end face 12, and an outer peripheral face 13 between the front end face 11 and the rear end face 12. The sleeve 1 further includes a sleeve hole 14 extending from the front end face 11 through the rear end face 12. The sleeve hole 14 includes an inner flange section 141 extending from an inner periphery of the front end of the sleeve hole 14 towards a longitudinal axis of the sleeve hole 14. The inner flange section 141 defines a first hole section 142. The inner flange section 141 has a first stop wall 143 and a second stop wall 144 respectively located on front and rear sides of the inner flange section 141. A second hole section 145 is defined between the front stop wall 143 and the front end face 11 of the sleeve 1 and has a diameter larger than a diameter of the first hole section 142. The sleeve hole 14 further includes a third hole section 146 located behind the second stop wall 144 and has a diameter larger than the diameter of the first hole section 142. The sleeve hole 14 further includes a fourth hole section 147 located behind the third through-hole 146 and having a diameter larger than the third hole section 146. The sleeve 1 further includes at least one through-hole 15 extending radially from the outer peripheral face 13 through an inner periphery of the sleeve hole 14. In this embodiment, the sleeve includes three through-holes 15 annularly spaced from each other by 120° and located corresponding to the fourth hole section 147. Each through-hole 15 has a reduced section 151 located adjacent to the sleeve hole 14 and having a diameter smaller than a remaining portion of the through-hole 15. In this embodiment, the sleeve 1 further includes an annular groove 131 defined in the outer peripheral face 13. The three through-holes 131 are defined in a bottom wall of the annular groove 131.

The magnetic ring 2 is mounted in the front end of the sleeve hole 14 of the sleeve 1. Specifically, the magnetic ring 2 is mounted in the second hole section 145. An outer diameter of the magnetic ring 2 is substantially equal to the diameter of the second hole section 145. The magnetic ring 2 can be securely coupled to the sleeve 1 by tight fitting or bonding. The magnetic ring 2 includes a through-hole 21 in a central portion thereof. After the magnetic ring 2 is mounted in the front end of the sleeve 1, a front end of the magnetic ring 2 is substantially flush with the front end face 11 of the sleeve 1, and a rear end of the magnetic ring 2 abuts the first stop wall 143, providing improved assembly stability.

The retaining ring 3 is made of a material more rigid than the sleeve 1. The retaining ring 3 can be made of low-carbon steel or high-carbon steel. The retaining ring 3 is mounted in the third hole section 146 and is located behind the magnetic ring 2. The retaining ring 3 includes a through-hole 31 in a central portion thereof. The retaining ring 3 has an outer diameter substantially equal to the diameter of the third hole section 146. The retaining ring 3 can be mounted in the third hole section 146 by tight fitting or bonding, and a front end of the retaining ring 3 abuts the second stop wall 144, providing improved assembly stability. A diameter of the through-hole 31 of the retaining ring 3 is substantially equal to the diameter of the first-hole section 142.

The holding device 4 is mounted on the sleeve 1 for providing the sleeve 1 and the screwdriver bit 5 with a holding force towards the longitudinal axis of the sleeve hole 14. The holding device 4 includes at least one ball 41 and a resilient ring 42. In this embodiment, the holding device includes three balls 41 respectively received in the three through-holes 15. Each ball 41 has a diameter smaller than the remaining portion of each through-hole 15 of the sleeve 1 but larger than the diameter of the reduced section 151 of each through-hole 15. Thus, each ball 41 is received in one of the through-holes 15 and is partially located in the sleeve hole 14 of the sleeve 1. The resilient ring 42 is mounted around the outer peripheral face 13 of the sleeve 1 and is received in the annular groove 131 in the outer peripheral face 13, biasing the balls 41 towards the longitudinal axis of the sleeve hole 14.

Figure 7:
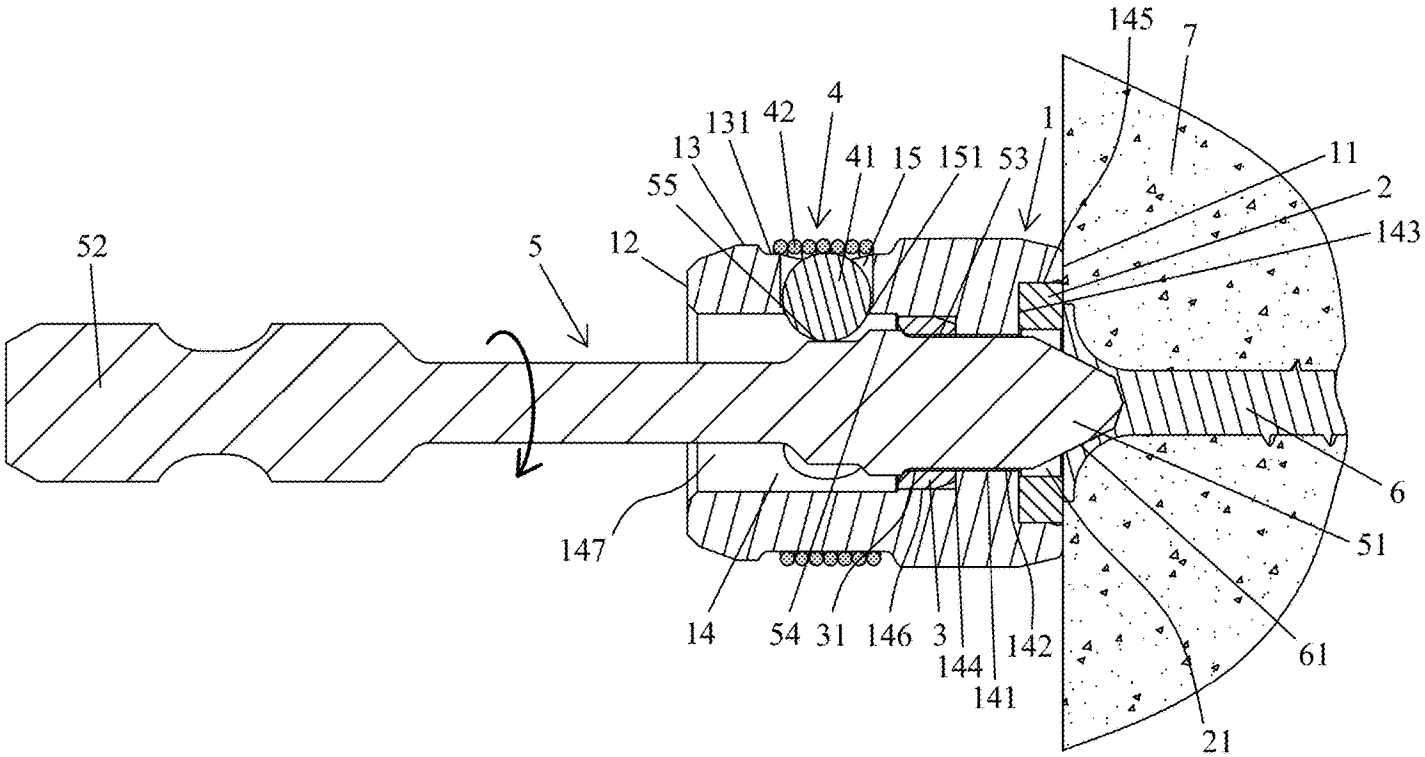
FIG. 7 is a diagrammatic cross sectional view illustrating use of the screwdriver bit assembly.
Figure 8:
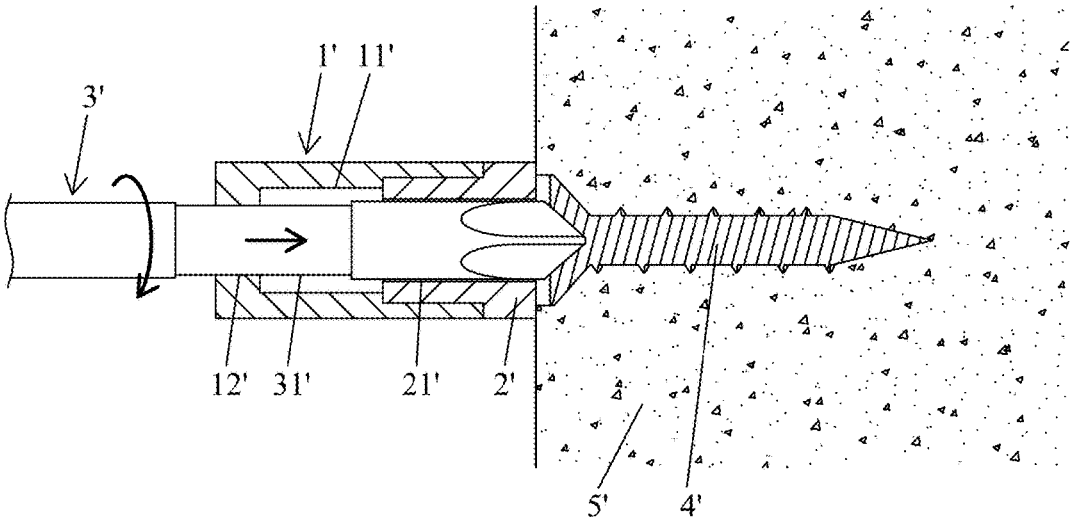
PRIOR ART F I G . 8
FIG. 8 is a diagrammatic cross sectional view illustrating use of a conventional screwdriver bit.

The screwdriver bit 5 has a rigidity larger than the sleeve 1 and can be made of metal. The screwdriver bit 5 includes an insertion end 51 on a front end thereof, a coupling end 52 on a rear end thereof, and an extending section 53 located behind the insertion end 51 and having a diameter slightly smaller than the diameter of the first hole section 142. With reference to FIG. 7, the insertion end 51 can couple with a groove 61 of a screw 6. The coupling end 52 is adapted to couple with an external tool (not shown), such as an electric tool or a manual tool. The screwdriver bit 5 further includes a flange section 54 located behind the extending section 53 and having a diameter larger than the diameter of the extending section 53. The screwdriver bit 5 further includes a clamping section 55 behind the flange section 54.

Figure 4:
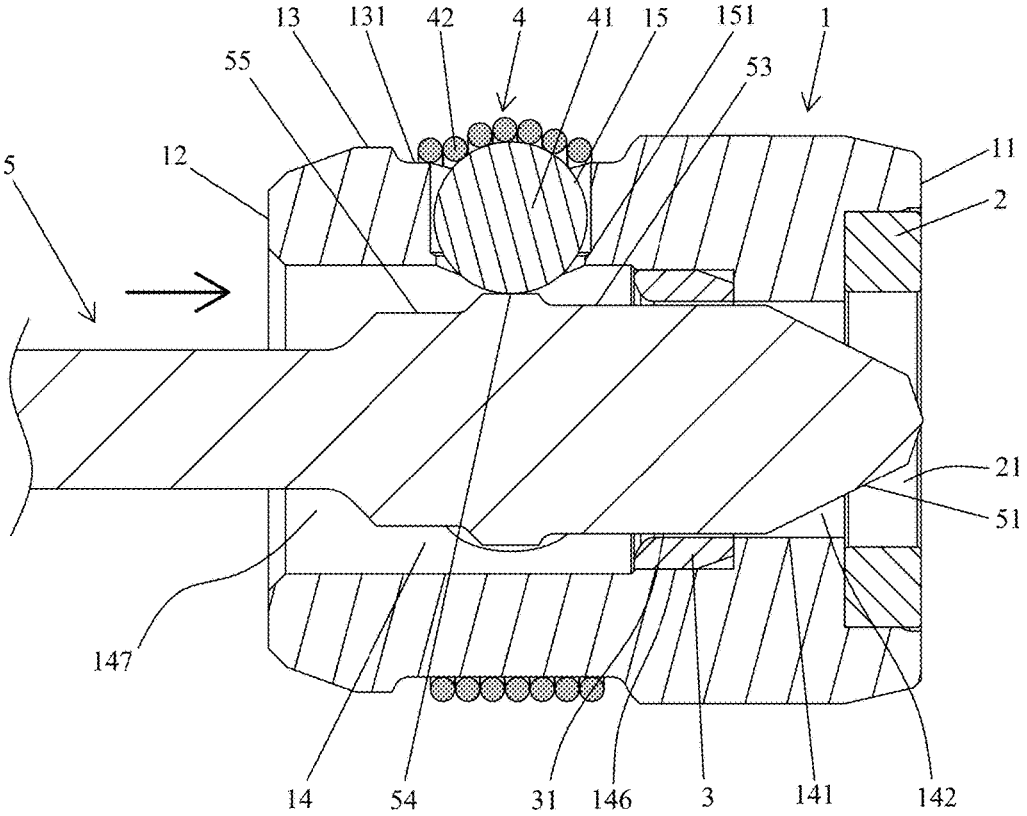
FIG. 4 is a partial, enlarged cross sectional view of the screwdriver bit assembly being assembled.
Figure 5:
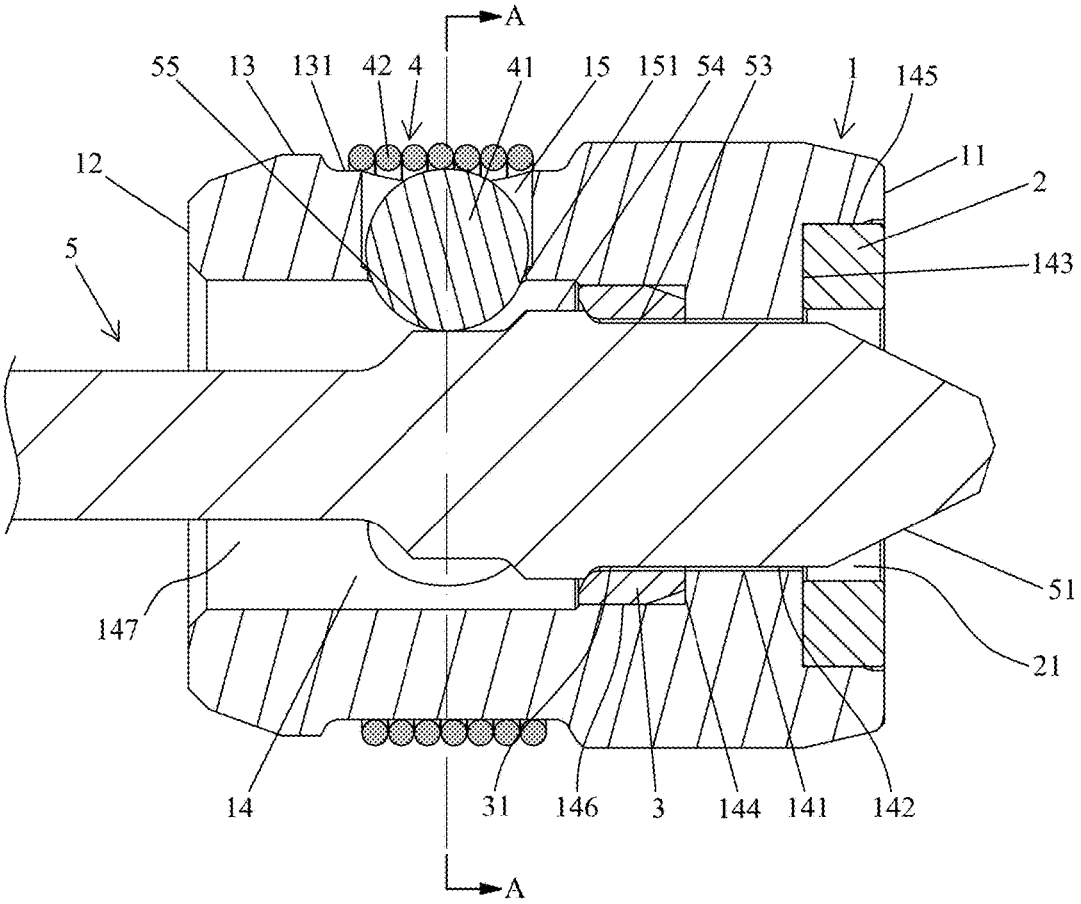
FIG. 5 is a view similar to FIG. 4, with the screwdriver bit assembly assembled.
Figure 6:
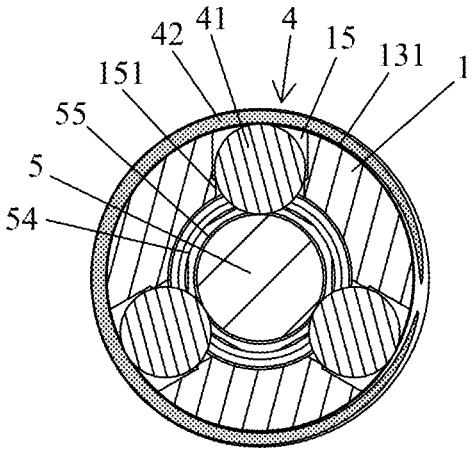
FIG. 6 is a cross sectional view taken along section line A-A of FIG. 5.

The front end of the screwdriver bit 5 extends through the sleeve hole 14 of the sleeve 1, the through-hole 31 of the retaining ring 3, and the through-hole 21 of the magnetic ring 2. With reference to FIG. 4, during this insertion procedure, the balls 41 move radially outwards in the radial holes 15. After the insertion procedure, the insertion end 51 extends beyond the sleeve 1 and is located in front of the front end face 11 of the sleeve 1. A front side of the flange section 54 abuts the retaining ring 3. With reference to FIGS. 5 and 6, each ball 41 is retained between the clamping section 55 and the resilient ring 42. Namely, the resilient ring 42 biases the balls 41 to press against the clamping section 55 of the screwdriver bit 5. The three balls 41 are spaced from each other by 120°, providing a more stable holding effect while avoiding the screwdriver bit 5 from moving along the longitudinal axis of the sleeve hole 14.

With reference to FIG. 7, when the insertion end 51 of the screwdriver bit 5 is inserted into the groove 61 of the screw 6, the top end of the screw 6 can be attracted by the magnetic ring 2, preventing the screw 6 from falling off. When the screwdriver bit 5 is rotated to tighten the screw 6 to a workpiece 7 or to detach the screw 6 from the workpiece 7, the front end of the flange section 54 abuts the retaining ring 3, avoiding the sleeve 1 from moving rearwards relative to the screwdriver bit 5. Thus, reliable attraction between the magnetic ring 2 and the screw 6 is maintained to assure reliable and stable operation. Furthermore, since the magnetic ring 3 abuts the flange section 54 of the screwdriver bit 5, the screw 6 and the screwdriver bit 5 cannot move further into the workpiece 7 when the front end face 11 of the sleeve 1 abuts against a surface of the workpiece 7, preventing damage to the workpiece 7.

Since the retaining ring 3 is made of a rigid material, wear is less likely to occur due to friction between the retaining ring 3 and the flange section 54 of the screwdriver bit 5, providing a longer service life. During rotation of the screwdriver bit 5, the clamping section 55 of the screwdriver bit 5 is securely held in a suitable clamped state by the balls 41, providing improved operational stability.

Although specific embodiments have been illustrated and described, numerous modifications and variations are still possible without departing from the scope of the invention. The scope of the invention is limited by the accompanying claims.

The invention claimed is:

1. A screwdriver bit assembly comprising: a sleeve including a front end face, a rear end face, and an outer peripheral face between the front end face and the rear end face, corresponding to an orientation of the sleeve, with the sleeve further including:

a sleeve hole extending from the front end face through the rear end face;

a magnetic ring mounted in a front end of the sleeve hole of the sleeve, with the magnetic ring including a through-hole in a central portion thereof;

a retaining ring made of a material more rigid than a material of the sleeve, with the retaining ring mounted in the sleeve hole and located behind the magnetic ring, and with the retaining ring including:

a through-hole in a central portion thereof;

a holding device mounted on the sleeve, providing a holding force towards a longitudinal axis of the sleeve hole; and a screwdriver bit having a rigidity larger than the sleeve, with the screwdriver bit including:

an insertion end on a front end thereof, a coupling end on a rear end thereof, and an extending section behind the insertion end, with the coupling end adapted to couple with an external tool, with the screwdriver bit further including:

a flange section located behind the extending section and having a diameter larger than a diameter of the extending section, with the screwdriver bit further including:

a clamping section behind the flange section, with the front end of the screwdriver bit extending through the sleeve hole of the sleeve, the through-hole of the retaining ring, and the through-hole of the magnetic ring, with the insertion end extending beyond the sleeve and located in front of the front end face of the sleeve, with the flange section having a front side abutting the retaining ring, and with the clamping section held by the holding device, with the sleeve hole of the sleeve including:

an inner flange section extending from an inner periphery of the front end of the sleeve hole towards the longitudinal axis, with the inner flange section defining a first hole section, the inner flange section having a first stop wall and a second stop wall respectively located on front and rear sides of the inner flange section, a second hole section defined between the front stop wall and the front end face of the sleeve and having a diameter larger than a diameter of the first hole section, the magnetic ring mounted in the second hole section, the sleeve hole further including a third hole section located behind the second stop wall and having a diameter larger than the diameter of the first hole section, and the retaining ring mounted in the third hole section.

2. The screwdriver bit assembly as claimed in claim 1, with the magnetic ring having a front end and a rear end, the front end of the magnetic ring flush with the front end face of the sleeve, the rear end of the magnetic ring abutting the first stop wall, the retaining ring having an outer diameter substantially equal to the diameter of the third hole section, and the retaining ring abutting the second stop wall.

3. A screwdriver bit assembly comprising: a sleeve including a front end face, a rear end face, and an outer peripheral face between the front end face and the rear end face, corresponding to an orientation of the sleeve, with the sleeve further including:

a sleeve hole extending from the front end face through the rear end face;

a magnetic ring mounted in a front end of the sleeve hole of the sleeve, with the magnetic ring including a through-hole in a central portion thereof;

a retaining ring made of a material more rigid than a material of the sleeve, with the retaining ring mounted in the sleeve hole and located behind the magnetic ring, and with the retaining ring including:

a through-hole in a central portion thereof;

a holding device mounted on the sleeve, providing a holding force towards a longitudinal axis of the sleeve hole; and a screwdriver bit having a rigidity larger than the sleeve, with the screwdriver bit including:

an insertion end on a front end thereof, a coupling end on a rear end thereof, and an extending section behind the insertion end, with the coupling end adapted to couple with an external tool, with the screwdriver bit further including:

a flange section located behind the extending section and having a diameter larger than a diameter of the extending section, with the screwdriver bit further including:

a clamping section behind the flange section, with the front end of the screwdriver bit extending through the sleeve hole of the sleeve, the through-hole of the retaining ring, and the through-hole of the magnetic ring, with the insertion end extending beyond the sleeve and located in front of the front end face of the sleeve, with the flange section having a front side abutting the retaining ring, and with the clamping section held by the holding device, wherein the screwdriver bit is made of metal, and the retaining ring is made of low-carbon steel or high-carbon steel.

* * * * *